US006981830B2

(12) United States Patent
Trovinger

(10) Patent No.: US 6,981,830 B2
(45) **Date of Patent: *Jan. 3, 2006**

(54) PIVOTABLE COLLECTING DEVICE

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 226 days.

This patent is subject to a terminal disclaimer.

(21) Appl. No.: 10/084,462

(22) Filed: Feb. 28, 2002

(65) Prior Publication Data

US 2003/0161705 A1 Aug. 28, 2003

(51) Int. Cl.
*B42C 9/00* (2006.01)
*B31B 1/68* (2006.01)

(52) U.S. Cl. ..... 412/33; 412/32; 270/52.26; 270/52.29; 270/52.3; 270/53

(58) Field of Classification Search ..... 412/32, 412/33; 270/52.26, 52.29, 52.3, 53
See application file for complete search history.

(56) References Cited

U.S. PATENT DOCUMENTS 3,774,901 A * 11/1973 McCain et al. ..... 270/52.29
4,053,150 A 10/1977 Lane
4,083,551 A * 4/1978 St. Denis ..... 270/52.18
4,085,927 A * 4/1978 Muller ..... 270/52.29
4,226,410 A 10/1980 McIntosh, Sr. et al.
4,410,170 A * 10/1983 Wertheimer et al. ..... 270/37
4,482,141 A * 11/1984 Moser ..... 198/644
4,489,930 A * 12/1984 Meier ..... 270/52.3
4,518,156 A * 5/1985 Moser ..... 270/52.14
4,595,187 A 6/1986 Bober
4,641,825 A * 2/1987 Mowry et al. ..... 270/52.26
4,684,116 A * 8/1987 Hansch ..... 270/52.3
4,732,374 A * 3/1988 Honegger ..... 270/52.3
4,891,681 A 1/1990 Fiske et al.
5,005,815 A * 4/1991 Auksi ..... 270/1.02
5,013,019 A * 5/1991 Samuels ..... 270/1.02
5,028,193 A 7/1991 Misicka
5,052,666 A * 10/1991 Hansch ..... 270/52.3
5,052,667 A * 10/1991 Hansch ..... 270/52.3
5,087,163 A 2/1992 Erdbories et al.
5,100,118 A * 3/1992 Hobbs et al. ..... 270/52.17
5,104,108 A * 4/1992 Honegger ..... 270/52.3
5,116,033 A * 5/1992 Honegger ..... 270/52.3
5,172,897 A * 12/1992 Hansch et al. ..... 270/52.18
5,292,110 A * 3/1994 Honegger ..... 270/52.26
5,324,014 A * 6/1994 Honegger et al. ..... 270/52.3
5,346,350 A 9/1994 Luhman et al.
5,377,965 A * 1/1995 Mandel et al. ..... 270/37
5,417,410 A * 5/1995 Meier ..... 270/52.18
5,452,920 A 9/1995 Parker
5,464,199 A * 11/1995 Stauber ..... 270/52.18

(Continued)

FOREIGN PATENT DOCUMENTS

EP 000569887 A1 * 12/1990

(Continued)

*Primary Examiner*—Boyer D. Ashley
*Assistant Examiner*—Mark Henderson

(57) ABSTRACT

A pivotable collecting device for handling a folded sheet material, including a supporting edge for supporting a fold of the folded sheet material, two supporting sides opposing one another, and means for pivoting the supporting edge and supporting sides about a first axis to receive the folded sheet material such that each supporting side receives a different portion of the folded sheet material, where the supporting sides converge at the supporting edge, and where the first axis is parallel to a longitudinal axis of the supporting edge.

30 Claims, 9 Drawing Sheets

U.S. PATENT DOCUMENTS 5,465,213 A 11/1995 Ross
5,593,148 A * 1/1997 Hansch ..... 270/52.3
5,615,871 A * 4/1997 Kleinhen ..... 270/45
5,657,978 A * 8/1997 Meier et al. ..... 270/52.16
5,667,211 A * 9/1997 Reist ..... 270/52.16
5,713,565 A * 2/1998 Meier ..... 270/52.16
5,758,871 A * 6/1998 Schlough ..... 270/52.27
5,794,926 A * 8/1998 Hansch ..... 270/52.26
5,803,891 A 9/1998 Haan et al.
5,810,345 A * 9/1998 Lehmann et al. ..... 270/52.26
5,820,325 A * 10/1998 Hartsoe ..... 412/1
5,975,182 A * 11/1999 Hartmann et al. ..... 156/538
6,099,225 A 8/2000 Allen et al.
6,120,427 A 9/2000 Haan et al.
6,193,458 B1 2/2001 Marsh
6,251,054 B1 * 6/2001 Cruz et al. ..... 493/383
6,270,068 B1 * 8/2001 Cracknell ..... 270/52.26
6,363,851 B1 4/2002 Gerhard et al.
6,375,179 B1 * 4/2002 Boss et al. ..... 270/52.27
6,517,064 B2 * 2/2003 Glanzmann ..... 270/52.28
6,550,756 B2 * 4/2003 Trovinger ..... 270/52.26
6,554,267 B2 * 4/2003 Trovinger ..... 270/52.18
6,578,838 B2 * 6/2003 Trovinger et al. ..... 270/52.18
6,612,559 B2 * 9/2003 Boss ..... 270/52.18
6,632,061 B2 * 10/2003 Trovinger ..... 412/11
6,673,002 B2 1/2004 Trovinger et al.
6,796,554 B2 * 9/2004 Trovinger ..... 270/52.26
2002/0140154 A1 * 10/2002 Trovinger ..... 270/58.08
2003/0069117 A1 4/2003 Trovinger et al.
2003/0069118 A1 4/2003 Trovinger et al.
2003/0069119 A1 4/2003 Trovinger et al.
2003/0161704 A1 * 8/2003 Trovinger ..... 412/25
2003/0162644 A1 * 8/2003 Trovinger ..... 493/405
2003/0214092 A1 * 11/2003 Horii et al. ..... 270/52.18
2004/0048728 A1 3/2004 Trovinger et al.
2004/0052613 A1 * 3/2004 Trovinger ..... 412/3
2004/0091336 A1 * 5/2004 Trovinger ..... 412/25
2005/0077671 A1 * 4/2005 Trovinger ..... 270/52.26

FOREIGN PATENT DOCUMENTS

EP 0813641 1/1998
EP 0992365 4/2000
GB 2176174 A * 12/1986
GB WO 00/18583 * 4/2000
WO 00/18583 4/2000
WO WO02078972 10/2002
WO WO02078974 10/2002

* cited by examiner

PIVOTABLE COLLECTING DEVICE

BACKGROUND OF THE INVENTION

1. Field of the Invention

The present invention generally relates to the handling of sheet material and, more particularly, to a pivoting collecting device for handling folded sheet material.

2. Background Information

A system for finishing printed sheets into booklets is described in U.S. Pat. No. 6,099,225 (Allen et al.), hereby incorporated by reference in its entirety, where most finishing operations are performed on a sheet-by-sheet basis using precise paper positioning. The Allen patent discloses an inverted V-shaped workpiece for collecting folded booklet sheets.

Another system for making booklets on a sheetwise basis is disclosed in PCT Document No. WO 00/18583 (Trovinger et al.), hereby incorporated by reference in its entirety. In the Trovinger PCT, individual folded booklet sheets are forwarded from a folding device to a linearly translating saddle, the reciprocation of which permits a trailing side of a folded sheet to be transported onto the backside of the saddle.

SUMMARY OF THE INVENTION

The present invention is directed to a pivotable collecting device for handling a folded sheet material.

According to an exemplary embodiment of the present invention, a pivotable collecting device for handling a folded sheet material is provided, including a supporting edge for supporting a fold of the folded sheet material, two supporting sides opposing one another, and means for pivoting the supporting edge and supporting sides about a first axis to receive the folded sheet material such that each supporting side receives a different portion of the folded sheet material, where the supporting sides converge at the supporting edge, and where the first axis is parallel to a longitudinal axis of the supporting edge.

According to another embodiment of the present invention, a method for transferring folded sheet material is provided, including the steps of receiving a first portion of the folded sheet material on a first supporting side of a collecting device, supporting a fold of the folded sheet material on a supporting edge of the collecting device, and pivoting the pivotable collecting device in a first direction such that a second supporting side of the pivotable collecting device receives a second portion of the folded sheet material, where the first and second supporting sides are opposing sides of the collecting device.

According to another embodiment of the present invention, a pivotable collecting device for handling a folded sheet material is provided, including a supporting edge for supporting a fold of the folded sheet material, two supporting sides opposing one another, and means for pivoting the supporting edge and supporting sides about a first axis to receive the folded sheet material such that each supporting side receives a different portion of the folded sheet material, where the supporting sides converge at the supporting edge, and where the first axis is parallel to a longitudinal axis of the supporting edge.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1A:
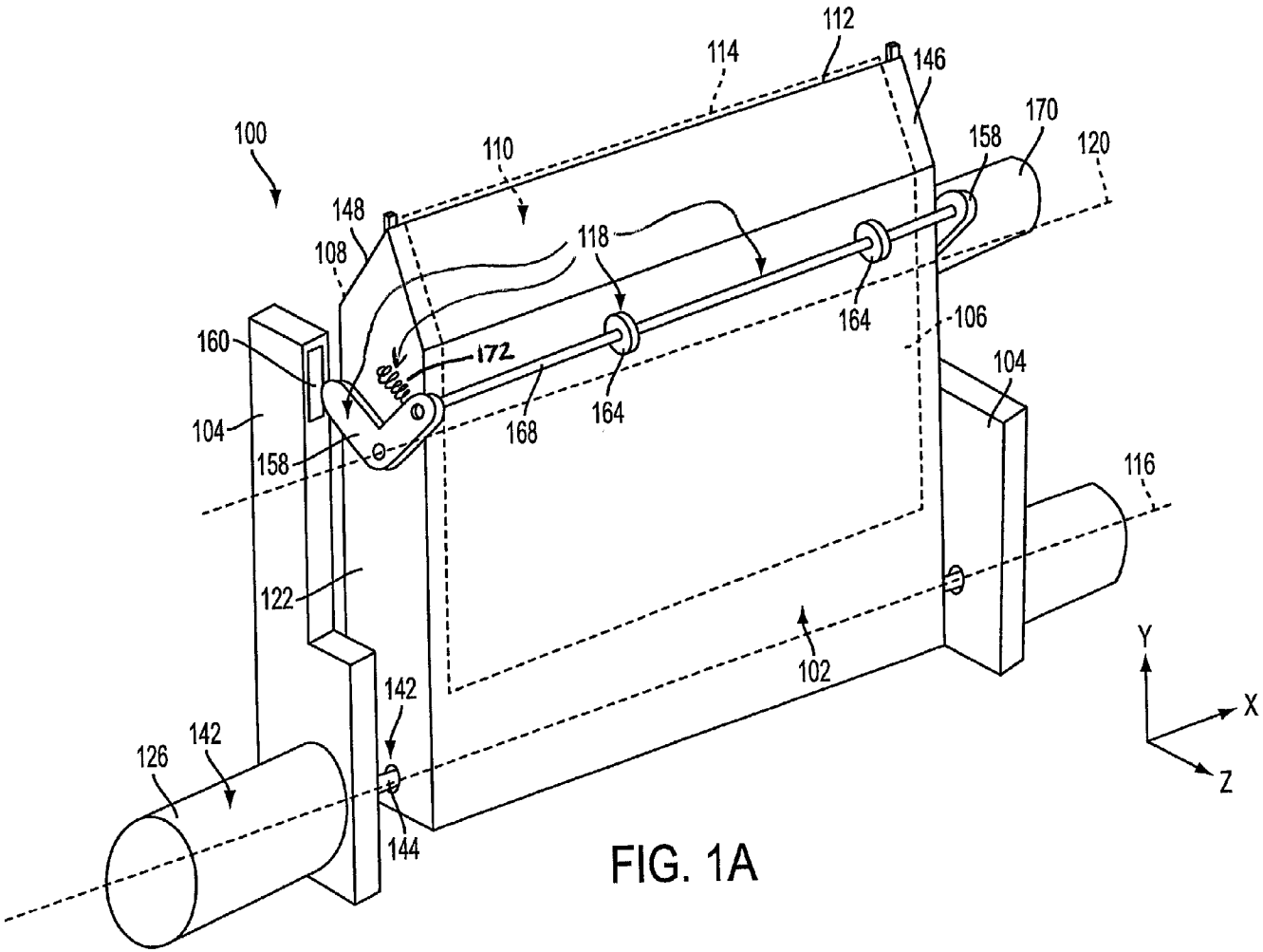
FIGS. 1A and 1B are perspective views of a collecting device in accordance with an exemplary embodiment of the present invention.

A pivotable collecting device is represented in FIG. 1A as pivotable collecting device 102, which can be arranged in a larger sheet handling apparatus 100. The exemplary pivotable collecting device 102 includes a supporting edge (e.g., supporting edge 112) for supporting a fold of the folded sheet material (e.g., fold 114 of folded sheet material 110). Supporting edge 112 can be formed as a sharp blade, or a cross-section of supporting edge 112 (i.e., in the y-z plane of FIG. 1A) can include some curvature (e.g., be rounded in shape) or sharp corners.

An exemplary embodiment includes two supporting sides (e.g., first and second supporting sides 146 and 148) opposing one another. For example, first and second supporting sides 146 and 148 are positioned on opposite sides of pivotable collecting device 102 and are substantially parallel to one another (with the exception of portions 146 and 148 that converge at supporting edge 112). However, alternatively, first and second supporting sides 146 and 148 can be arranged such that an obtuse or acute angle exists between them, and such an arrangement would remain within the definition of the term "opposing" in the context of the present invention. For example, in exemplary FIG. 1A, pivotable collecting device 102 is shaped as a saddle (e.g., arranged as an inverted V), including a first supporting side 146, a second supporting side 148, a supporting edge 112, and mounting sides 122. Sides 146, 148, and 112 are shown in FIG. 1A to interface at sharp angles (e.g., right angles), but can alternatively be connected by curved edges. Further, sides 146, 148, and 112 can be arranged in indirect contact with one (e.g., the sides can be separately mounted on a support frame). Also, mounting sides 122 can be arranged substantially perpendicular to supporting sides 146 and 148, or can alternatively be arranged at different angles.

Pivotable collecting device 102 is shown to be in an upright position in FIG. 1A, with first supporting side 146 and second supporting side 148 arranged in the x-y plane, and with the force of gravity acting in the –y direction. This orientation is non-limiting, of course, and collecting apparatus 100 can be configured in any orientation that provides for the transfer and support of folded sheet material. First supporting side 146 and second supporting side 148 are respectively used for supporting a first portion and a second portion of a folded sheet material, such as first portion 106 and second portion 108 of sheet material 110. First and second portions 106 and 108 can also be referred to as leading and trailing sides, respectively. Supporting edge 112 supports a fold of a folded sheet material, such as fold 114.

Pivotable collecting device 102 can be made of metal, plastic, or any other formable material capable of supporting multiple sheets of folded material.

In an exemplary embodiment, a means (e.g., drive means 142) is provided for pivoting the supporting edge and supporting sides about a first axis (e.g., axis 116) to receive the folded sheet material such that each supporting side receives a different portion of the folded sheet material. For example, pivotable collecting device 102 pivots about axis 116 to receive folded sheet material 110, where such movement is achieved with the use of drive means 142, which pivots pivotable collecting device 102 toward or away from a processing device (e.g., one of processing devices 234–240 in FIG. 2A, for example). Axis 116 can be parallel to a longitudinal axis of supporting edge 112 (i.e., along the x-axis in FIG. 1A), or can be alternatively arranged at some acute angle to supporting edge 112. Due to the controlled pivoting of pivotable collecting device 102, first portion 106 can be delivered to first supporting side 146, while second portion 108 can be delivered to second supporting side 148.

Drive means 142 includes a motor 126 and a rotatable shaft 144 attached to pivotable collecting device 102, whereby rotation of shaft 144 by motor 126 results in a pivoting of pivotable collecting device 102 about axis 116. Motor 126 is mounted to a support 104 and can be of any type (such as electric, pneumatic, or hydraulic). Also, pivotable collecting device 102 can be rotated by motor 126 via alternative power transmitting means, such as a chain, belt, and/or gear system. Further, drive means 142 can, alternatively, be any means for actuating, such as a piston.

A collecting drive (e.g., collecting drive 118) is provided in an exemplary embodiment for clamping the folded sheet material against at least one of the supporting sides and/or advancing the folded sheet material along the at least one supporting side. For example, in FIG. 1A, pivotable collecting device 102 includes collecting drive 118, which pivots about a second axis, such as axis 120. Axis 120 can be parallel to axis 116, or can alternatively be arranged at an acute angle to axis 116. Collecting drive 118 can be rotatably mounted on mounting sides 122, or can be alternatively mounted on another portion of pivotable collecting device 102. Included in collecting drive 118 are tires 164, a rotatable shaft 168, arms 158, and biasing members 172. Biasing members 172 can be helical springs, rubber elements, or any other means for biasing. Tires 164 are fixedly mounted on shaft 168 and can be made of metal or any other formable material, and can be coated with an elastomeric or any other deformable material (such as rubber, for example). FIG. 1A illustrates two tires 164, but any number of tires can be used.

In an exemplary embodiment, collecting drive 118 pivots based on a pivoting movement of pivotable collecting device 102. For example, shaft 168 is rotatably mounted on arms 158, at least one of which is shaped such that shaft 168 and tires 164 rotate about axis 120 when the arm 158 contacts a redirection area 160 on support 104. For example, an exemplary arm 158 is angled in such a way that when pivotable collecting device 102 moves into an upright position (shown in FIGS. 1 and 2A), arm 158 is forced by the fixed redirection area 160 to counteract the force of biasing members 172 and to thus rotate about axis 120. Redirection area 160 can be an integral portion of support 104 (e.g., a channeled-out section of the material of support 104) or can be a separate component (e.g., an attached rubber plate). Also, redirection area 160 can simply be a surface area of support 104 that an arm 158 contacts. Arms 158 can be made of metal, plastic, or any other formable material that can withstand the forces associated with the described function.

Using these components, exemplary collecting drive 118 can be used to clamp folded sheet material against first supporting side 146 and to advance folded sheet material along first supporting side 146 (e.g., in the +y or −y direction when pivotable collecting device 102 is in an upright position). Clamping of folded sheet material by collecting drive 118 is achieved by movement of arms 158 due to the force of biasing members 172 and the absence of contact between arm 158 and redirection area 160 (as shown in FIG. 2B). Alternatively, collecting drive 118 can be in the form of any means for clamping folded sheet material against a surface. For example, collecting drive 118 can include clamping members that are linearly translated toward pivotable collecting device 102 by a separate drive means.

Once folded sheet material is clamped against first supporting side 146, advancement of folded sheet material is achieved by rotation of shaft 168 and tires 164, which is controlled by a drive means 170. Drive means 170 can rotate shaft 168 independently of the rotation of arms 158. Also, drive means 170 can be any means for driving known in the art, and can include, for example, any type of motor and power transmitting means known in the art, as described above with respect to drive means 142.

Figure 1B:
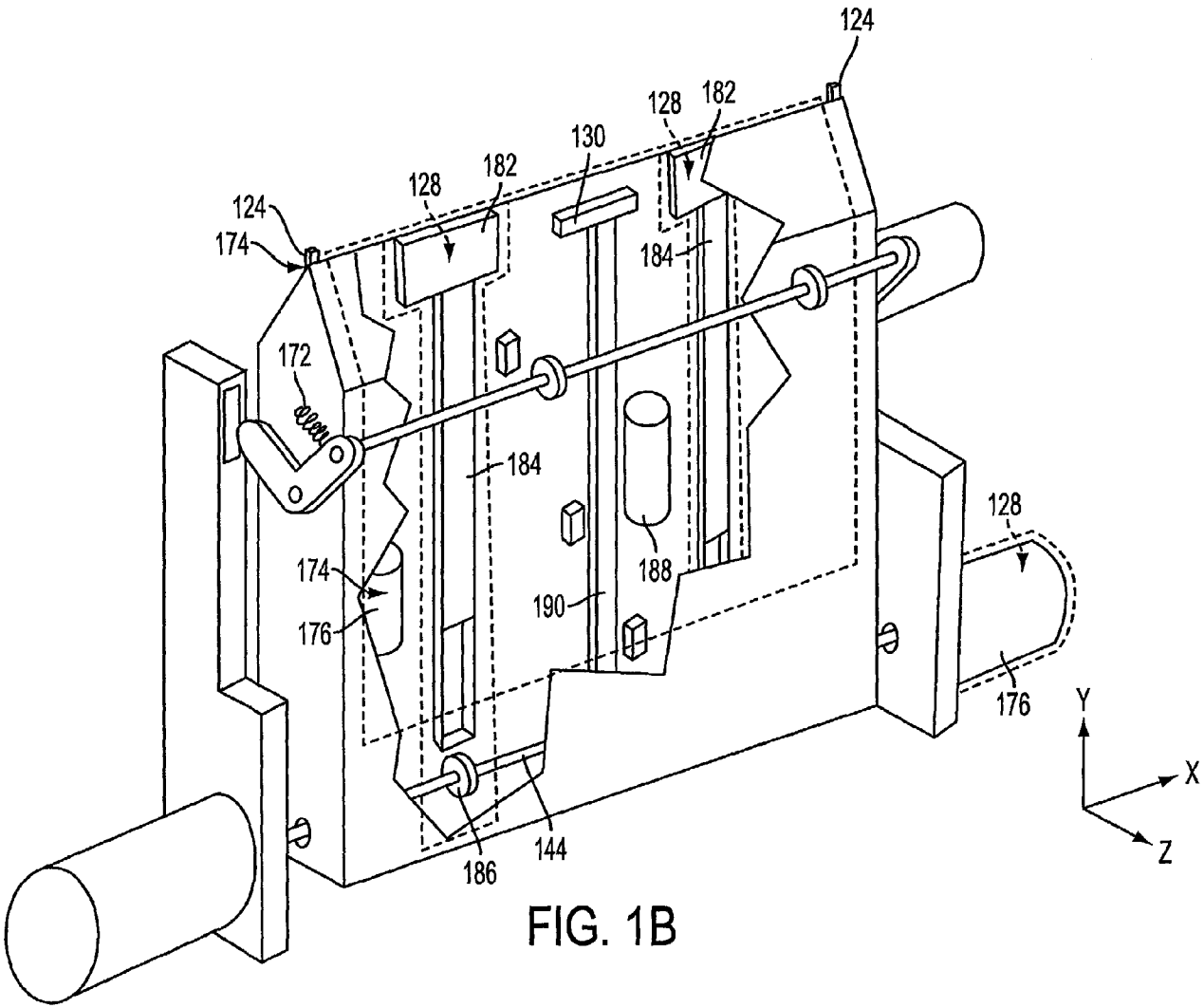

An exemplary embodiment also includes a means for aligning the folded sheet material, such as aligning means 174, which includes jogging fingers 124 and motor 176 in the FIG. 1B example. Jogging fingers 124 can be positioned to extend from an interior space in pivotable collecting device 102 (e.g., through a hole or slot in second supporting side 148) or can be positioned entirely on the exterior surface of pivotable collecting device 102 (e.g., on second supporting side 148). Also, motor 176 can be arranged either within an interior space or externally to pivotable collecting device 102. When a desired quantity of folded sheet material is transferred to pivotable collecting device 102, at least one of jogging fingers 124 (shown in FIG. 1B) can be moved along the side of supporting edge 112 by motor 176 to align the sides of folded sheet material along the x-axis. This step can be performed in anticipation of a stapling operation, for example. Aligning means 174 can alternatively be in the form of any other means for aligning stacked sheets.

Also provided in an exemplary embodiment is a means for staple clinching, such as staple clinching means 128, which includes clinch plates 182, push rods 184, and clinch cams 186 arranged on shaft 144. Alternatively, clinch cams 186 can be arranged on a shaft separate from shaft 144. Clinching means 128 can operate as active clinch units described in co-pending U.S. Patent Application entitled "STAPLING APPARATUS FOR A BOOKLET MAKER" filed Mar. 30, 2001), the disclosure of which is hereby incorporated by reference in its entirety. Alternatively, clinching means 128 can be any means known in the art for clinching staples.

The exemplary pivotable collecting device also includes an ejecting member, such as ejecting member 130, for ejecting the folded sheet material from the pivotable collecting device. Ejecting member 130 can be positioned within or externally from pivotable collecting device 102, and can be shaped as a thin flat plate with enough structural length along the x-axis to lift folded sheet material away from supporting edge 112 when actuated by a motor 188 via connector 190. If positioned within pivotable collecting device 102, ejecting member 130 can protrude (when actuated) through a slit in supporting edge 114. Alternatively, ejecting member 130 can be arranged and actuated by any means for ejecting.

Figure 3:
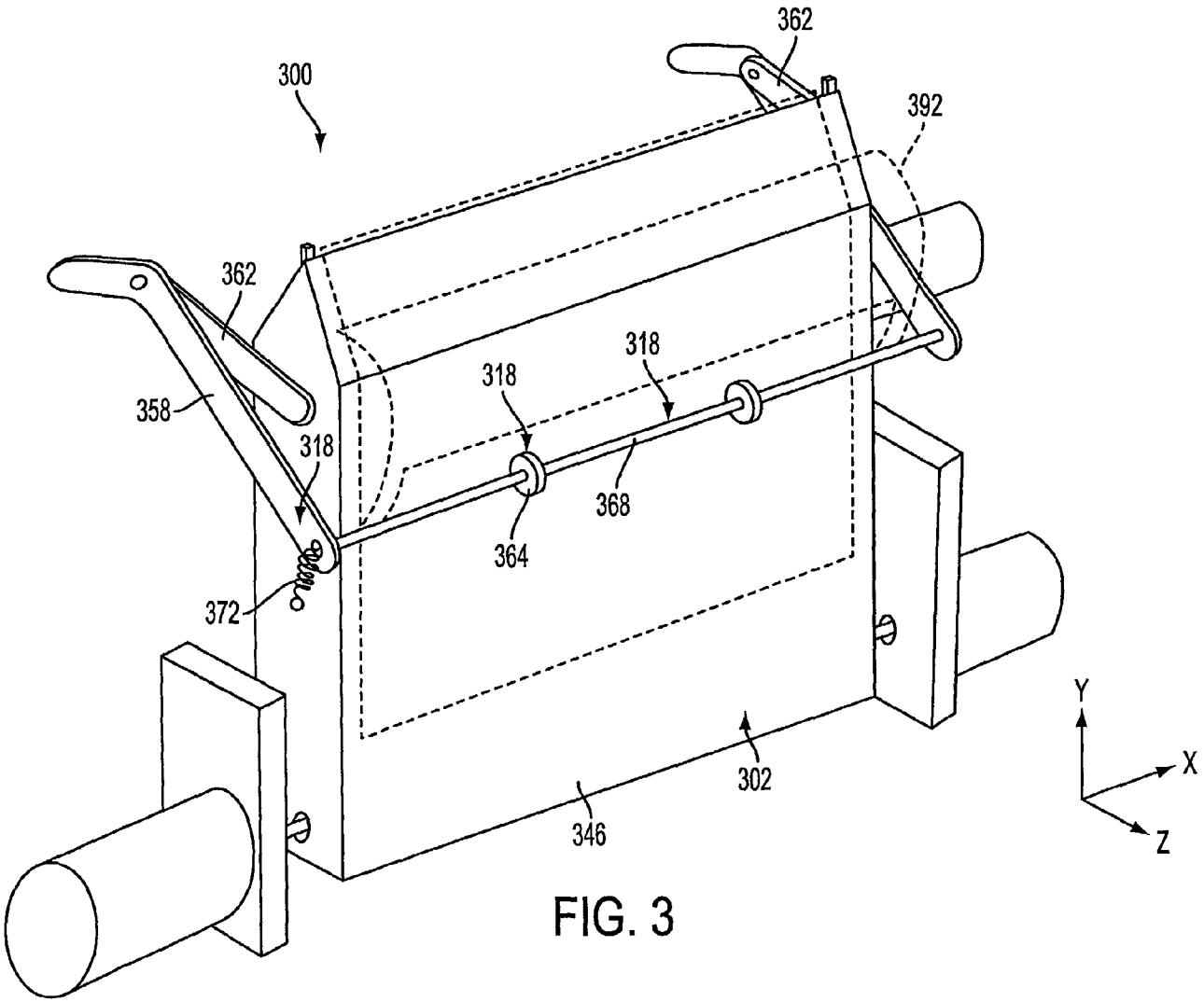
FIG. 3 is a perspective view of a collecting device in accordance with another exemplary embodiment of the present invention.

In the FIG. 3 example, collecting apparatus 300 is provided with extensions 362, which are fixedly mounted on pivotable collecting device 302. In this exemplary embodiment, collecting drive 318 includes at least one arm 358 that is rotatably mounted on an extension 362. In a closed position, shown in FIG. 3, arm 358 is forced by biasing element 372 to clamp shaft 368 and tires 364 against first supporting side 346. In an open position, shown in FIG. 4A, arm 358 contacts a redirection member 456 (due to rotational movement of pivotable collecting device 402) and pivots such that shaft 368 and tires 364 move away from first supporting side 346.

Figure 4A:
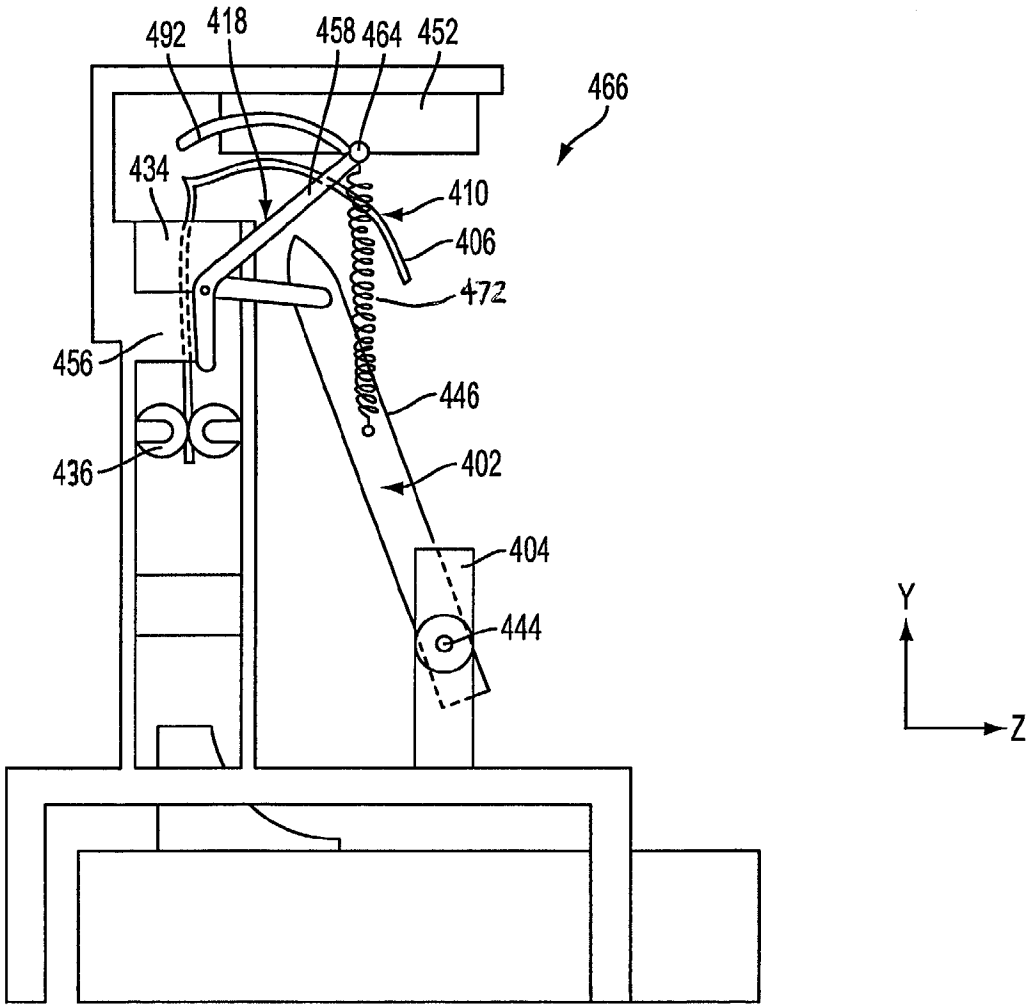
FIGS. 4A–4C are side views of a sheet processing system including the exemplary collecting device of FIG. 3.
Figure 4B:
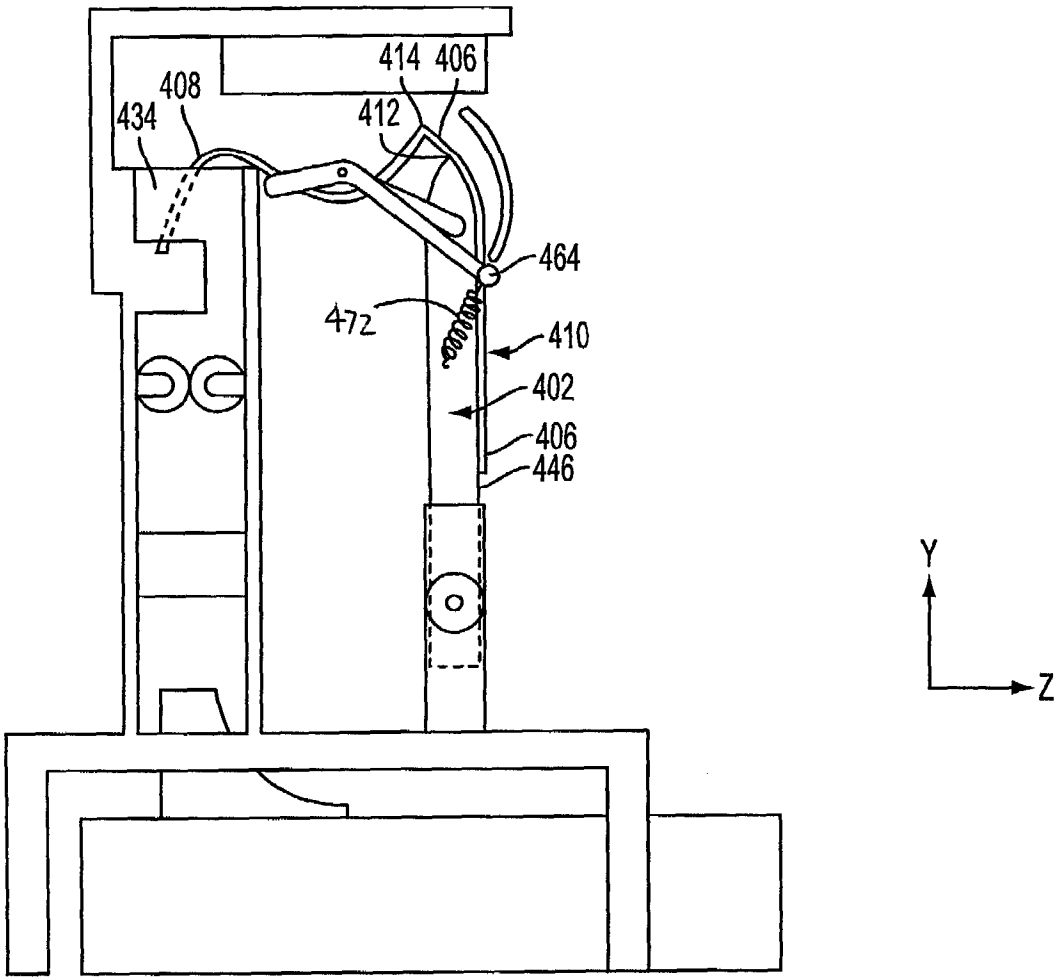
Figure 4C:
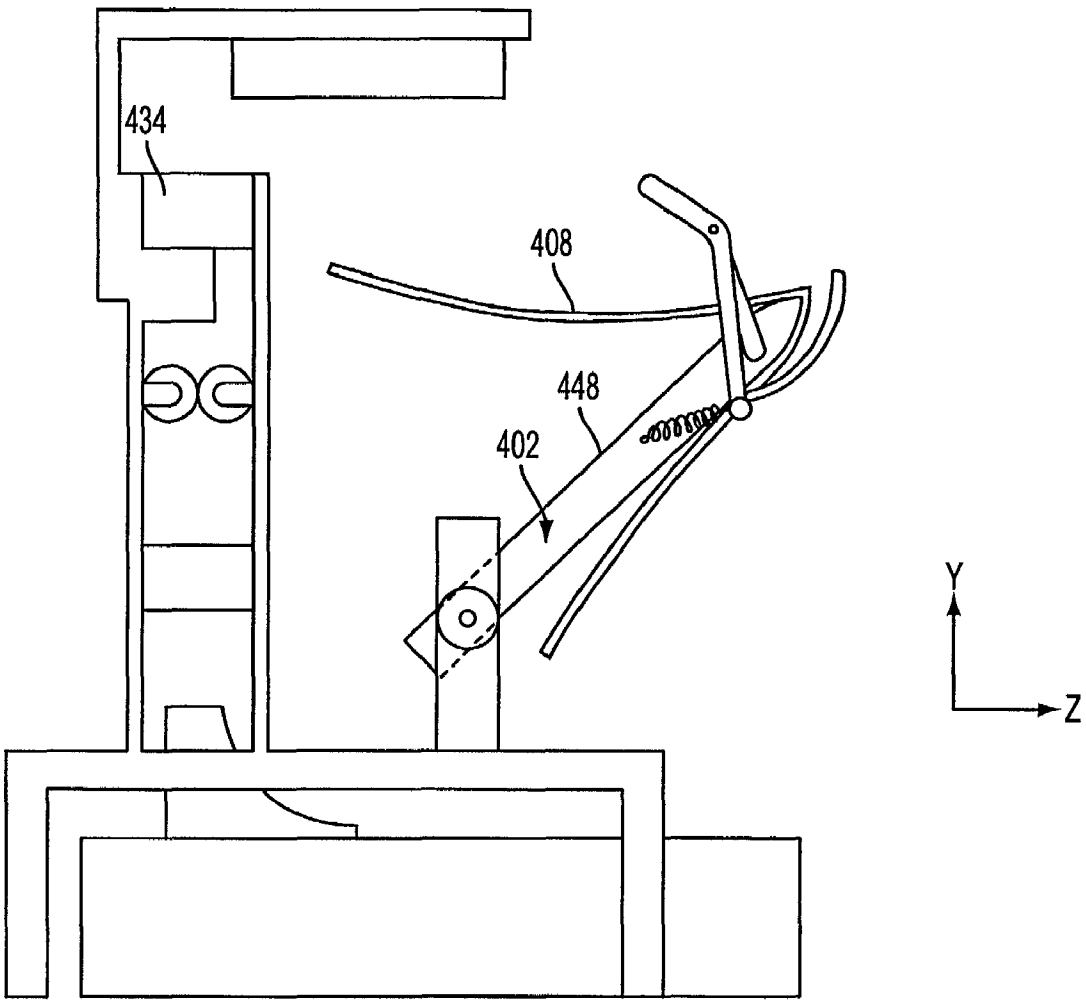

Also provided in collecting apparatus 300 is a deflector 392, which can be fixedly mounted on either shaft 368 or arms 358; in this way, deflector 392 rotates along with shaft 368, as shown in FIGS. 4A–4C. Deflector 392 can be formed as a curved component made of any formable material with a surface finish smooth enough for sheet material to easily pass along.

Figure 5:
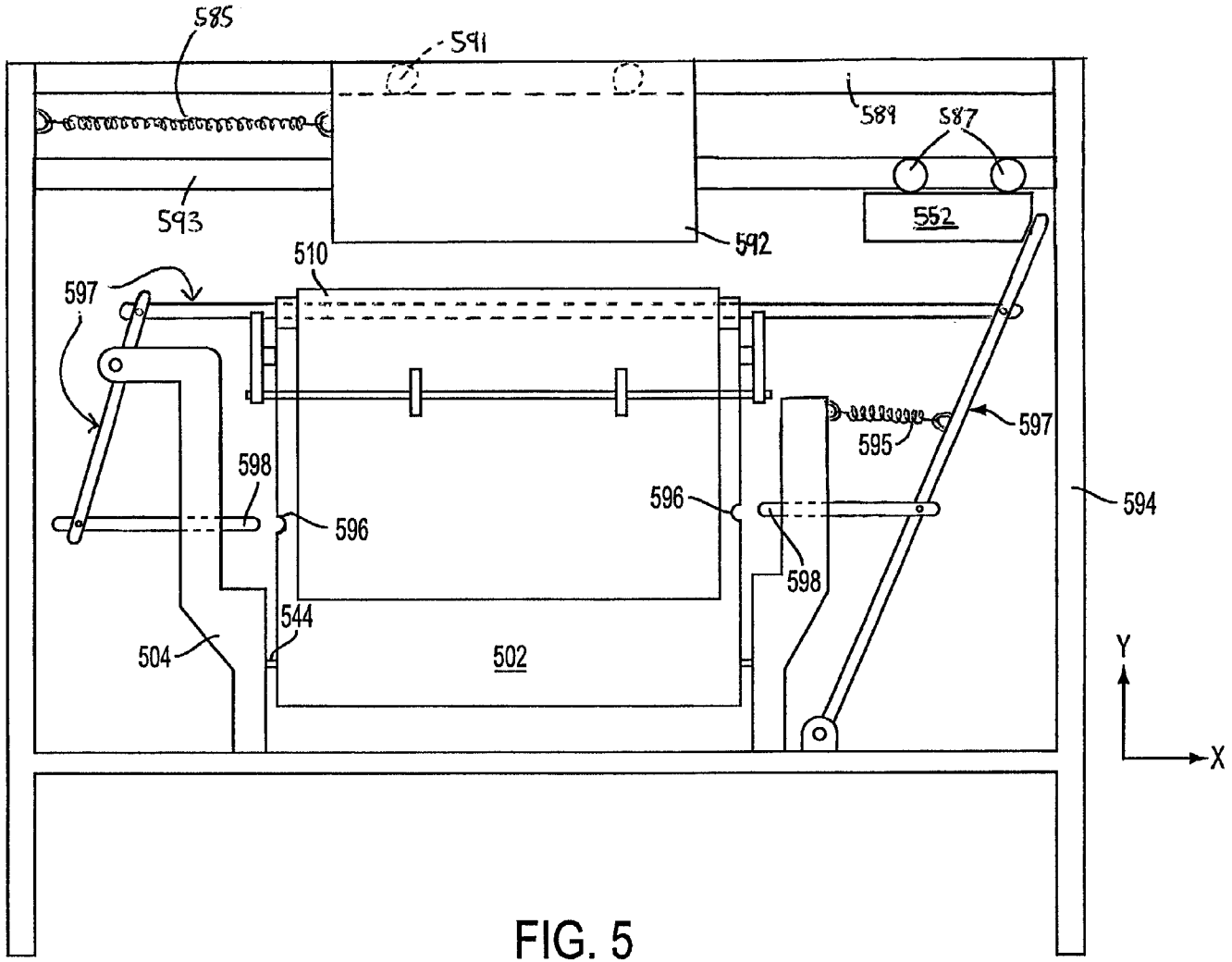
FIG. 5 is a front view of a sheet processing system including the exemplary collecting device of FIG. 1 or FIG. 3.

Also, as shown in FIG. 5, deflector 592 can be arranged such that stapling device 552 will move it out of the path of folded sheets when stapling device 552 translates toward collecting device 502. For example, deflector 592 is translatably mounted onto frame rod 589 with rollers 591 and is held in an initial, deflecting position with a biasing member 585. As stapling device 552 translates along rod 593 (via rollers 587) toward collecting device 502 (i.e., in the −x direction), it can contact and push deflector 592 in the −x direction and out of the path of folded sheets. Due to a force from biasing member 585, deflector 592 can return to an initial position when stapling device 552 translates back to the position shown in FIG. 5. Alternatively, deflector 592 can be moved out of the paper path in any other manner (e.g., movement of stapling device 552 can cause deflector 592 to rotate about the y-axis out of the paper path).

With reference to FIG. 3, pivotable collecting device 302 can include any of the features included in pivotable collecting device 102. Also, alternatively, collecting drive 318 can be formed as any other means for clamping sheet material against a surface and advancing sheet along the surface, while allowing a collecting device (e.g., collecting device 302) to pivot relative to an upstream device (e.g., folding device 434).

Figure 2A:
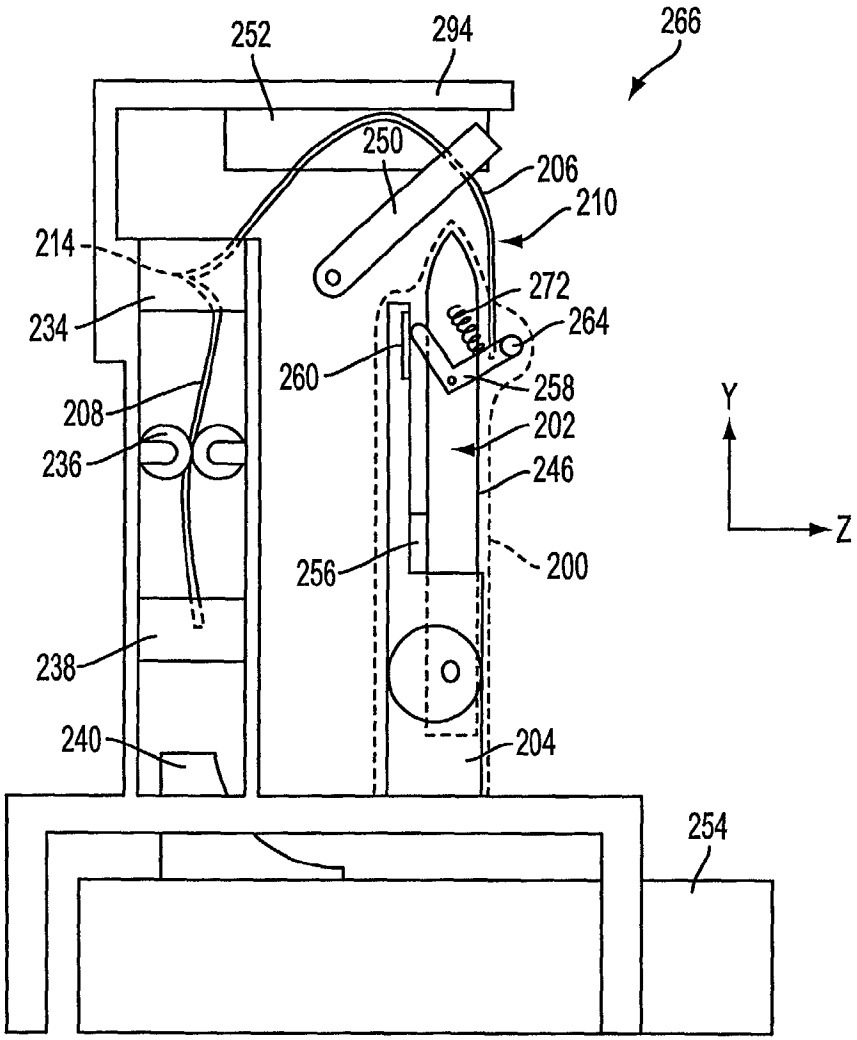
FIGS. 2A and 2B are side views of a sheet processing system including the exemplary collecting device of FIG. 1.
Figure 2B:
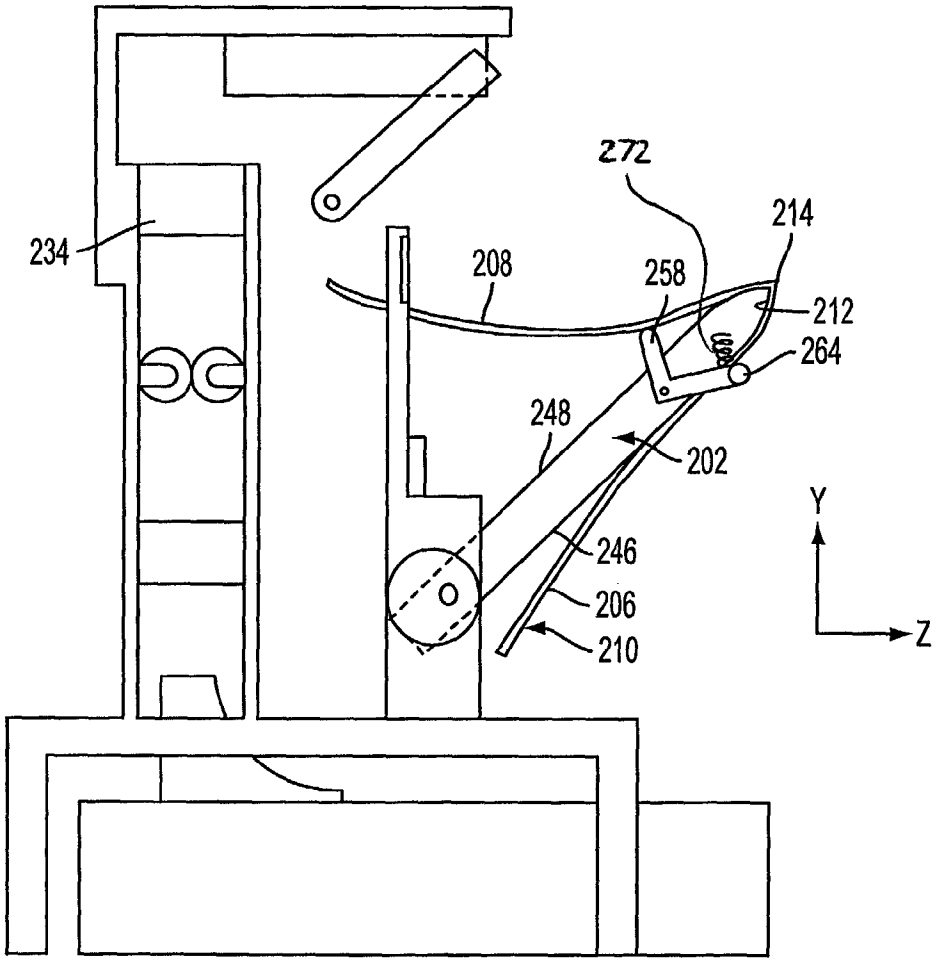

A system for handling sheet material is represented in exemplary FIGS. 2A and 2B as system 266 and in exemplary FIGS. 4A–C as system 466. In FIG. 2A, system 266 includes a pivotable collecting device 202 (having any or all of the features described with respect to pivotable collecting device 102) and a number of processing devices, such as folding device 234, material drive 236, cutting device 238, and cutting device 240. System 266 can include any or all of these exemplary devices, and can also include any other devices known in the art of sheet processing (such as a hole punching device, for example). All of the processing devices can be mounted on a common frame 294, which can be of any material and configuration known in the art. Support 204 can be attached to or integral with frame 294. Exemplary system 266 also includes a sheet material tray 254, from which cutting device 240 initially receives sheet material to be processed. Sheet material 210 can be arranged in sheet material tray 254 as multiple, discrete sheets or as a continuous strip of material. Also, sheet material 210 can be of any material, thickness, and width known in the art.

System 266 also includes a transferring device 250, which can be arranged and used as the clamping drive described in co-pending U.S. patent application Ser. No. 09/820,740, entitled "APPARATUS FOR ADVANCEMENT OF PAPER IN A NON-LINEAR PATH", the disclosure of which is hereby incorporated by reference in its entirety. Transferring device 250 can also be arranged and used as the clamping drive described in co-pending U.S. patent application Ser. No. 10/084,459 entitled "SYSTEM FOR HANDLING FOLDED SHEET MATERIAL" (attorney docket no. 10015158, filed on even date), the disclosure of which is hereby incorporated by reference in its entirety. For example, transferring device 250 can be used to secure stacked folded sheet material to pivotable collecting device 202 during a stapling operation. Alternatively, transferring device 250 can be any means for transferring sheet material.

Also provided in system 266 is a stapling device 252, which can be arranged as the stapling apparatus described in co-pending U.S. patent application Ser. No. 09/820,743, entitled "STAPLING APPARATUS FOR A BOOKLET MAKER", the disclosure of which is hereby incorporated by reference in its entirety. Alternatively, stapling device 252 can be arranged as any means for stapling.

Attached or integral to support 204 is a stop 256, which may be made of the same or a different material of support 204. As shown in FIG. 2A, stop 256 prevents the rotation of pivotable collecting device 202 beyond a certain point (e.g., beyond around the upright position in the counter-clockwise direction). Stop 256 may be adjustable (e.g., to properly align pivotable collecting device 202 with stapling device 252 during a stapling process) and, accordingly, may include such components as precision screws or other known adjusting means in the art.

With reference to FIG. 4A, a system 466 is shown including most of the features of system 266. In system 466, however, pivotable collecting device 402 is allowed to pivot beyond an upright position in the counter-clockwise direction (i.e., toward a processing device such as folding device 434), as support 404 is not provided with a stop (e.g., stop 256 in FIG. 2A). Also, redirection member 456 is arranged on frame 494 to cause a rotation of arm 458 as pivotable collecting device 402 pivots toward folding device 434.

A method for transferring folded sheet material is provided, including a step of receiving a first portion of the folded sheet material (e.g., first portion 206 of folded sheet material 210 in FIG. 2A) on a first supporting side of a pivotable collecting device (e.g., first supporting side 246 of pivotable collecting device 202). In FIG. 2A, first portion 206 of folded sheet material 210 is clamped by transferring device 250 and rotated such that first portion 206 enters a space between tires 264 and first supporting side 246. A fold 214 in folded sheet material 210 can be created by folding apparatus 234, which can, for example, be arranged and used as described in any of the following co-pending applications, all filed on Oct. 5, 2001, the disclosures of which are hereby incorporated by reference in their entirety: Application No. 09/970,877 "SHEET FOLDING APPARATUS WITH PIVOT ARM FOLD ROLLERS", Application No. 09/970,730 "SHEET FOLDING APPARATUS", Application No. 09/970,748 "THICK MEDIA FOLDING METHOD", Application No. 09/971,351 "VARIABLE MEDIA THICKNESS FOLDING METHOD" and Application No. 09/970,840 "SHEET FOLDING APPARATUS WITH ROUNDED FOLD BLADE". Alternatively, folding apparatus 234 can be arranged as any means for folding. Also, in this position, stapling device 252 is moved out of the way of transferring device 250 and folded sheet material 210 (as shown in FIG. 5).

In the FIG. 4A embodiment, a step of receiving is shown which includes pivoting the pivotable collecting device (e.g., pivotable collecting device 402) in a second direction (e.g., counter-clockwise about shaft 444 in FIG. 4A) to receive the first portion of the folded sheet material (e.g., first portion 406). In this embodiment, a separate transferring device is not used. Instead, pivotable collecting device 402 is allowed to pivot beyond an upright position in the counter-clockwise direction such that a first portion 406 of folded sheet material 410 can be received on first supporting side 446.

To aid in this transfer, a step of deflecting (e.g., with deflector 492 in FIG. 4A or 592 in FIG. 5) the first portion of the folded sheet material onto the first supporting side of the pivotable collecting device is provided. As shown in FIG. 4A, collecting drive 418 is in an open position, with arm 458 contacting redirection member 456 and, as a result, tires 464 moved away from first supporting side 446. This position allows first portion 406 to be advanced out of folding device 434 by paper drive 446 and to be moved unobstructedly onto first supporting side 446 by deflector 492.

Also provided is a step of pivoting the pivotable collecting device (e.g., pivotable collecting device 202 or pivotable collecting device 402) in a first direction such that a second supporting side of the pivotable collecting device receives a second portion of the folded sheet material, and a step of clamping the first portion of the folded sheet material against the first supporting side of the pivotable collecting device. In the FIG. 2B example, pivotable collecting device 202 pivots away from folding device 234 after first portion 206 has entered a space between tires 264 and first supporting side 246. In this way, second portion 208 is pulled from the area of folding device 234 (or, alternatively, another processing device upstream from pivotable collecting device 202) and allowed to fall against and be received by second supporting side 248. Also resulting from the pivoting movement of pivotable collecting device 202 (and a subsequent rotation of arm 258) is a clamping of first portion 206 against first supporting side 246 by tires 264. Alternatively, first portion 206 can be clamped against first supporting side 246 before pivotable collecting device 202 begins to pivot away from folding device 234. For example, tires 264 can be linearly translated against first portion 206 and first supporting side 246 by a separate motor.

A step of advancing the first portion of the folded sheet material along the first supporting side of the pivotable collecting device is also provided in an exemplary embodiment. For example, tires 264 are rotated to advance first portion 206 along first supporting side 246 until fold 214 is received and supported on supporting edge 212. This operation properly positions sheet material 210 onto pivotable collecting device 202 and also helps to transfer sheet material 210 out of an upstream processing device (e.g., folding device 234). Any means for sensor can be used to detect the receiving of fold 214 on supporting edge 212, such as optical or weight-sensitive sensors. An advancement of folded sheet material 210 can occur before, during, or after a pivoting of pivotable collecting device 202 away from folding device 234.

In FIGS. 4B and 4C, the steps of pivoting, clamping, and advancing are illustrated in an exemplary embodiment that omits the need for a transferring device intermediate to a pivotable collecting device and a processing device. With reference to FIG. 4B, pivotable collecting device 402 pivots to an upright position from the position shown in FIG. 4A. This movement helps to begin pulling second portion 408 out from folding device 434. Also, at this position, arm 458 loses contact with redirection member 456 and, due to the force of biasing member 472, rotates in the clockwise direction of FIG. 4B such that tires 464 clamp first portion 406 to first supporting side 446. In this way, clamping of first supporting side 446 can occur before, during the time, or after pivotable collecting device 402 reaches the upright position. Alternatively, tires 464 can clamp folded sheet material 410 against first supporting side 446 by any other means for clamping, such as through linear translation.

Once first portion 406 is clamped to first supporting side 446, tires 464 can be rotated to advance first portion 406 along first supporting side 446 until fold 414 is received by supporting edge 412. Any means for sensing can be used to detect the receiving of fold 414 on supporting edge 412, such as optical or weight-sensitive sensors. An advancement of first portion 406 can occur before, during, or after a pivoting of pivotable collecting device 402 away from folding device 434.

In the FIG. 4C example, pivotable collecting device 402 is shown to be pivoted further from folding device 434 beyond the upright position shown in FIG. 4B. In this way, second portion 408 is completely pulled from the area of folding device 434 (or, alternatively, another processing device upstream from pivotable collecting device 402) and allowed to fall against and be received by second supporting side 448.

Also provided in an exemplary embodiment is a step of locking the pivotable collecting device (e.g., pivotable collecting device 502 in FIG. 5) when a desired amount of folded sheet material is received by the pivotable collecting device. This step can, for example, be used to ensure alignment between pivotable collecting device 502 and stapling device 552 when a collected stack of folded sheet material is ready to be fastened together. Pivotable collecting device 502 (which can represent either pivotable collecting device 202 or 402) is provided with at least one notch 596. Each notch 596 is formed to receive and retain a correspondingly-shaped locking member 598, and pivotable collecting device 502 is prevented from pivoting about shaft 544 when locking members 598 engage notches 596. Such engagement can be realized, for example, by movement of stapling device 552 from its position shown in FIG. 5 toward the pivotable collecting device 502 (i.e., the −x direction) for stapling purposes. This movement results in disengagement between stapling device 552 and a portion of linkage 597, and, due to a force applied by biasing member 595, linkage 597 moves such that locking members 598 engage notches 596. Alternatively, the locking of pivotable collecting device 502 can be achieved by any means known for preventing the movement of components.

Exemplary embodiments of the present invention can be modified to include features from any or all of the following copending applications, all filed on even date herewith, the disclosures of which are hereby incorporated by reference in their entirety: U.S. patent application Ser. No. 10/084,459, entitled "System for Handling Folded Sheet Material", (Trovinger, S.) and U.S. patent application No. 10/084,460, entitled "Booklet Maker", (Trovinger, S.).

What is claimed is:

1. A pivotable collecting device for handling a folded sheet material, comprising:

a supporting edge for supporting a fold of the folded sheet material;

two supporting sides opposing one another and converge at the supporting edge;

a bottom side, wherein the supporting edge, two supporting sides and bottom side enclose a volume;

means for pivoting the supporting edge and supporting sides about a first axis to receive the folded sheet material such that each supporting side receives a different portion of the folded sheet material, the first axis between the two supporting sides and positioned within the volume; and a collecting drive for at least one of: clamping the folded sheet material against at least one of the supporting sides, and advancing the folded sheet material along the at least one supporting side.

2. The pivotable collecting device of claim 1, wherein the first axis is parallel to a longitudinal axis of the supporting edge.

3. The pivotable collecting device of claim 1, wherein the supporting sides are substantially parallel to one another.

4. The pivotable collecting device of claim 1, wherein: the collecting drive is rotatably mounted on at least one mounting side, and the at least one mounting side is arranged substantially perpendicular to the supporting sides.

5. The pivotable collecting device of claim 1, wherein the collecting drive rotates based on a pivoting movement of the supporting edge and supporting sides.

6. The pivotable collecting device of claim 1, wherein the collecting drive rotates about a second axis parallel to the first axis.

7. The pivotable collecting device of claim 1, comprising:

means for deflecting the folded sheet material onto at least one of the supporting sides.

8. The pivotable collecting device of claim 1, wherein the pivotable collecting device comprises:

means for aligning the folded sheet material on the supporting edge.

9. The pivotable collecting device of claim 1, wherein the pivotable collecting device comprises:

means for staple clinching.

10. The pivotable collecting device of claim 1, wherein the pivotable collecting device comprises: means for ejecting the folded sheet material from the supporting edge.

11. The pivotable collecting device of claim 1, wherein the first axis is at an acute angle to a longitudinal axis of the supporting edge.

12. A pivotable collecting device for handling a folded sheet material, comprising:

a supporting edge for supporting a fold of the folded sheet material;

two supporting sides opposing one another;

means for pivoting the supporting edge and supporting sides about a first axis to receive the folded sheet material such that each supporting side receives a different portion of the folded sheet material, the first axis between the two supporting sides; and a collecting drive for at least one of: clamping the folded sheet material against at least one of the supporting sides, and advancing the folded sheet material along the at least one supporting side, wherein the collecting drive rotates based on at least one of a biasing element and contact between the collecting drive and a redirection area.

13. The pivotable collecting device of claim 12, wherein the first axis is parallel to a longitudinal axis of the supporting edge.

14. The pivotable collecting device of claim 12, wherein the first axis is at an acute angle to a longitudinal axis of the supporting edge.

15. The pivotable collecting device of claim 12, wherein the supporting sides are substantially parallel to one another.

16. The pivotable collecting device of claim 12, wherein: the collecting drive is rotatably mounted on at least one mounting side, and the at least one mounting side is arranged substantially perpendicular to the supporting sides.

17. The pivotable collecting device of claim 12, wherein the collecting drive rotates based on a pivoting movement of the supporting edge and supporting sides.

18. The pivotable collecting device of claim 12, wherein the collecting drive rotates about a second axis parallel to the first axis.

19. The pivotable collecting device of claim 12, comprising:

means for deflecting the folded sheet material onto at least one of the supporting sides.

20. The pivotable collecting device of claim 12, wherein the pivotable collecting device comprises:

means for aligning the folded sheet material on the supporting edge.

21. The pivotable collecting device of claim 12, wherein the pivotable collecting device comprises:

means for staple clinching.

22. The pivotable collecting device of claim 12, wherein the pivotable collecting device comprises:

means for ejecting the folded sheet material from the supporting edge.

23. A method for transferring folded sheet material, comprising the step of:

receiving a first portion of the folded sheet material on a first supporting side of a collecting device;

supporting a fold of the folded sheet material on a supporting edge of the collecting device;

pivoting the pivotable collecting device in a first direction such that a second supporting side of the pivotable collecting device receives a second portion of the folded sheet material, wherein the first and second supporting sides are opposing sides of the collecting device; and clamping the first portion of the folded sheet material against the first supporting side of the collecting device: and wherein the receiving step includes pivoting the pivotable collecting device in a second direction to receive the first portion of the folded sheet material.

24. The method of claim 23, comprising the step of:

deflecting the first portion of the folded sheet material onto the first supporting side of the collecting device.

25. The method of claim 23, comprising the step of:

advancing the first portion of the folded sheet material along the first supporting side of the collecting device.

26. The method of claim 23, comprising the step of:

locking the pivotable collecting device when a desired amount of folded sheet material is received by the pivotable collecting device.

27. A pivotable collecting device for handling a folded sheet material, comprising:

a supporting edge for supporting a fold of a folded sheet material;

two supporting sides opposing one another;

a bottom side, wherein the supporting edge, two supporting sides and bottom side enclose a volume;

means for pivoting the supporting edge and supporting sides about a first axis to receive the folded sheet material such that each supporting side receives a different portion of the folded sheet material, wherein the supporting sides converge at the supporting edge and joins to the two supporting sides, and the first axis is parallel to a longitudinal axis of the supporting edge and is between the two supporting sides and positioned within the volume; and a collecting drive for at least one of: clamping the folded sheet material against at least one of the supporting sides, and advancing the folded sheet material along the at least one supporting side.

28. The pivotable collecting device of claim 27, wherein the collecting drive rotates based on a pivoting movement of the supporting edge and supporting sides.

29. The pivotable collecting device of claim 27, wherein the collecting drive rotates based on at least one of a biasing element and contact between the collecting drive and a redirection area.

30. The pivotable collecting device of claim 27, wherein the collecting drive rotates about a second axis parallel to the first axis.

* * * * *